US008961155B2

(12) United States Patent
Shipman

(10) Patent No.: US 8,961,155 B2
(45) Date of Patent: Feb. 24, 2015

(54) PERISTALTIC LINEAR PUMP AND METHOD OF OPERATION

(76) Inventor: Douglas Shipman, Durham, NC (US)

( * ) Notice: Subject to any disclaimer, the term of this patent is extended or adjusted under 35 U.S.C. 154(b) by 161 days.

(21) Appl. No.: 13/399,814

(22) Filed: Feb. 17, 2012

(65) Prior Publication Data

US 2012/0213646 A1 Aug. 23, 2012

Related U.S. Application Data

(60) Provisional application No. 61/444,726, filed on Feb. 19, 2011.

(51) Int. Cl.
*F04B 43/12* (2006.01)
*F04B 43/08* (2006.01)

(52) U.S. Cl.
CPC ..... *F04B 43/082* (2013.01); *F04B 43/12* (2013.01); *F04B 43/1207* (2013.01)
USPC ..... 417/474; 417/475

(58) Field of Classification Search
CPC ..... F04B 43/08; F04B 43/082; F04B 43/086; F04B 43/12; F04B 43/123; F04B 43/1223; F04B 13/00; F04B 13/02
USPC ..... 417/474, 477.1, 477.3, 477.6, 477.7, 417/477.9, 477.11, 477.12; 604/153
See application file for complete search history.

(56) References Cited

U.S. PATENT DOCUMENTS

| | | | |
|---|---|---|---|
| 3,877,609 | A | 4/1975 | Cullis |
| 4,014,318 | A | 3/1977 | Dockum et al. |
| 4,165,954 | A | 8/1979 | Amos |
| 4,293,961 | A | 10/1981 | Runge |
| 4,355,638 | A | 10/1982 | Iwatschenko et al. |
| 4,496,295 | A | 1/1985 | King |
| 4,561,830 | A | 12/1985 | Bradley |
| 4,671,792 | A | 6/1987 | Borsanyi |
| 4,893,991 | A | 1/1990 | Heminway et al. |
| 4,906,168 | A | 3/1990 | Thompson |
| 4,909,710 | A | 3/1990 | Kaplan et al. |
| 5,024,586 | A | 6/1991 | Meiri |
| 5,044,901 | A | 9/1991 | Fumero et al. |
| 5,290,158 | A | 3/1994 | Okada |
| 5,423,759 | A | 6/1995 | Campbell |
| 5,494,415 | A | 2/1996 | Morita |
| 5,554,123 | A | 9/1996 | Herskowitz |

(Continued)

FOREIGN PATENT DOCUMENTS

| | | |
|---|---|---|
| CN | 101810896 | 8/2010 |
| EP | 0560270 A2 | 9/1993 |
| WO | WO 9421918 A1 * | 9/1994 |

OTHER PUBLICATIONS

"Peristaltic Pumps" Manufactured by RolaTec Pump Co., from website http//:rolatecpump.com/, Dec. 16, 2009.

(Continued)

*Primary Examiner* — Devon Kramer
*Assistant Examiner* — Christopher Brunjes
(74) *Attorney, Agent, or Firm* — Muir Patent Law, PLLC

(57) ABSTRACT

The present disclosure provides a linear peristaltic pump that is capable of dispensing varied amounts of liquid from a tube. The linear peristaltic pump includes an adjustably attached squashing plate that is configured to move lengthwise in the housing of the pump. The amount of liquid dispensed from a tube disposed in the pump varies based on the location of the squash plate in the housing.

12 Claims, 8 Drawing Sheets

(56) References Cited

U.S. PATENT DOCUMENTS

| | | | | |
|---|---|---|---|---|
| 5,630,711 | A | 5/1997 | Luedtke et al. | |
| 5,683,233 | A | 11/1997 | Moubayed et al. | |
| 5,807,322 | A | 9/1998 | Lindsey et al. | |
| 5,924,852 | A | 7/1999 | Moubayed et al. | |
| 5,941,696 | A | 8/1999 | Fenstermacher et al. | |
| 5,964,583 | A | 10/1999 | Danby | |
| RE37,074 | E | 2/2001 | Danby et al. | |
| 6,213,739 | B1 | 4/2001 | Phallen et al. | |
| 6,413,059 | B1 | 7/2002 | Pringle | |
| 6,554,589 | B2 | 4/2003 | Grapes | |
| 6,629,955 | B2 | 10/2003 | Morris et al. | |
| 7,059,840 | B2 | 6/2006 | Corwin et al. | |
| 8,366,420 | B1 * | 2/2013 | Geschwender | 417/475 |
| 2001/0016706 | A1 | 8/2001 | Leukanech et al. | |
| 2006/0177329 | A1 | 8/2006 | Firmann | |
| 2006/0228240 | A1 | 10/2006 | Schroeder et al. | |
| 2009/0263256 | A1 | 10/2009 | Bobo et al. | |
| 2009/0306592 | A1 | 12/2009 | Kasai et al. | |
| 2010/0111733 | A1 * | 5/2010 | Ramunas et al. | 417/474 |

OTHER PUBLICATIONS

"How a Persistaltic Pump Operates—Liquid Pumps—Clark Solutions" from website http://www.clarksol.com/html/peristaltic_pump.cfm.

"Masterflex Tubing Types" from website http://www.mastertlex.com/search/Masterflex%20Peristaltic%20Pumps.

International Search Report dated May 29, 2012, PCT Application PCT/US/12/25687.

* cited by examiner

PERISTALTIC LINEAR PUMP AND METHOD OF OPERATION

CROSS-REFERENCE TO RELATED APPLICATIONS

This application claims the benefits, under 35 U.S.C §119, to U.S. Provisional Application No. 61/444,726 filed Feb. 19, 2011, the entirety of which is incorporated by reference herein.

BACKGROUND

Exemplary embodiments relate to a peristaltic pump used to pump, for example, sterile or aggressive liquids. More particularly, exemplary embodiments relate to a peristaltic pump capable of dispending variable amounts of liquid from a tube, and a method of operation and a method of manufacture of the same.

SUMMARY

In an exemplary embodiment, a peristaltic linear pump to dispense a varied volume of liquid from a tube comprises a base plate with at least a first groove formed in a top surface of the base plate, the first groove configured to hold a first tube in a lengthwise direction; a first bump formed at a first end of the base plate and in the first groove, the first bump extending above the first groove; a downstream valve configured to prevent liquid in the first tube from flowing upstream, a housing including a first movable arm disposed lengthwise in the housing; a first squash plate adjustably fixed in the first movable arm and configured to move lengthwise in the first movable arm, the first movable arm having a greater length than the first squash plate, wherein the first squash plate is configured to squash a portion of the first tube, the portion of the squashed first tube extending from a downstream end of the first squash plate to the first bump; wherein an amount of liquid dispensed from the first tube by the pump varies based upon a location of the first squash plate in the movable arm.

In an exemplary embodiment, a peristaltic linear pump to dispense a varied volume of liquid from a tube comprises a base plate with at least a first groove formed in a top surface of the base plate, the first groove configured to hold a first tube in a lengthwise direction; a first bump formed at a first end of the base plate and in the first groove, the first bump extending above the first groove; a downstream valve configured to prevent liquid in the first tube from flowing upstream, a housing including a first movable arm disposed lengthwise in the housing; a first plate adjustably fixed in the first movable arm, the first movable arm having a greater length than the first plate, wherein the first plate is configured to compress a portion of the first tube, the portion of the compressed first tube extending from a downstream end of the first plate to the first bump; wherein an amount of liquid dispensed from the first tube by the pump varies based upon a location of the first plate in the first movable arm.

In an exemplary embodiment, a peristaltic linear pump to dispense a varied volume of liquid from a tube comprises a housing including an adjustably attached flattening bar, wherein the flattening bar is configured to move lengthwise within the housing; a bottom plate with at least a first trench formed therein, the first trench configured to hold a first tube in a lengthwise direction; a first protrusion extending upwardly from an upstream end of the first trench; a first pincher disposed at a downstream end of the first trench, the first pincher configured to prevent liquid in the first tube from flowing upstream; wherein the flattening bar is configured to close a portion of the first tube from the first protrusion to a downstream end of the flattening bar such that the first pincher is opened and the liquid in the closed portion of the first tube is dispensed, and wherein an amount of liquid dispensed from the first tube by the pump varies based upon a location of the flattening bar in the housing.

In an exemplary embodiment, a method of dispensing a varied volume of liquid from a tube using a linear peristaltic pump comprises the steps of placing a tube in a groove of the pump, the groove having a bump at an upstream end of the groove and a pinching valve at the downstream end of the groove; rotating a squash plate downward such that the squash plate closes the tube at the bump; dispensing a volume of liquid in the tube by rotating the squash plate further downward such that the squash plate closes the tube from the bump to the pinching valve, wherein a length of the tube that is closed by the squash plate is adjustable.

BRIEF DESCRIPTION OF THE FIGURES

The above and other objects and features of the disclosure will become more apparent by describing in detail exemplary embodiments thereof with reference to the attached drawings, in which.

DETAILED DESCRIPTION

Figure 1A:
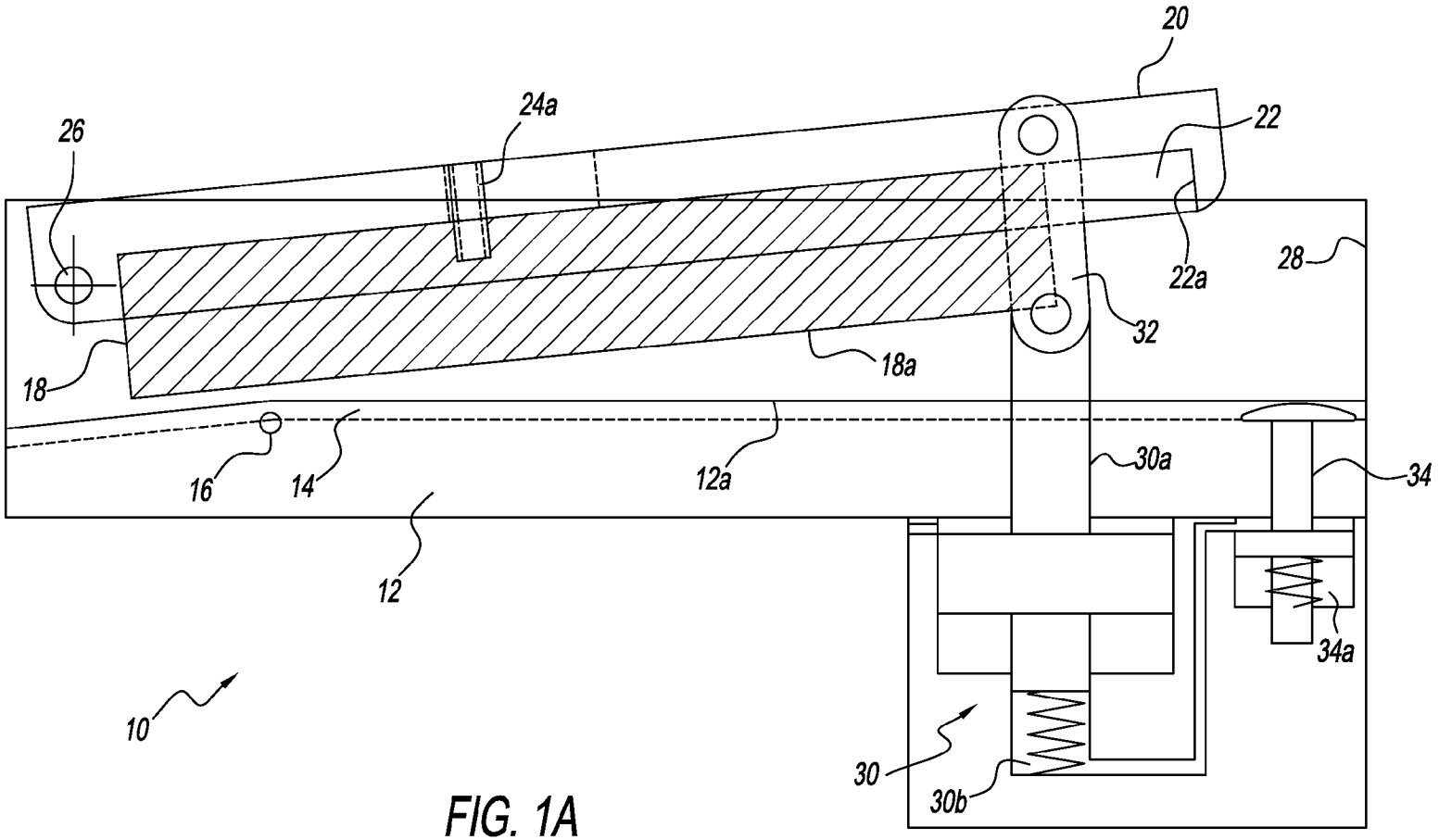
FIGS. 1A and 1B are a cross-sectional view of a peristaltic pump according to an exemplary embodiment.

The present disclosure will now be described more fully below with reference to the accompanying drawings, in which various embodiments are shown. This invention may, however, be embodied in many different forms and should not be construed as limited to the embodiments set forth herein. In the drawings, the size and relative sizes of layers and regions may be exaggerated for clarity. Like numbers refer to like elements throughout.

It will be understood that, although the terms first, second, third etc. may be used herein to describe various elements, components, regions, layers and/or sections, these elements, components, regions, layers and/or sections should not be limited by these terms. Unless indicated otherwise, these terms are only used to distinguish one element, component, region, layer or section from another region, layer or section. Thus, a first element, component, region, layer or section discussed below could be termed a second element, component, region, layer or section, and, similarly, a second element, component, region, layer or section discussed below could be termed a first element, component, region, layer or section without departing from the teachings of the disclosure.

Locational terms, such as "beneath", "below", "lower", "under", "above", "upper" and the like, may be used herein for the ease of describing one element's or feature's relationship to another element(s) or feature(s) as illustrated in the figures. It will be understood that the locational terms are intended to encompass different orientations of the device in use or operation in addition to the orientation depicted in the figures. For example, if the device in the figures is turned over, elements described as "below" or "beneath" or "under" other elements or features would then be oriented "above" the other elements or features. Thus, the term "below" can encompass both an orientation of above and below. The device may be otherwise oriented (rotated 90 degrees or at other orientations) and the locational descriptors used herein should be interpreted accordingly. In addition, it will also be understood that when a layer or an element is referred to as being "between" two layers or elements, it can be the only layer or element between the two layers or elements, or one or more intervening layers or elements may also be present.

The terminology used herein is for the purpose of describing particular embodiments only and is not intended to be limiting of the invention. As used herein, the singular forms "a", "an" and "the" should not exclude the plural forms as well, unless the context clearly indicates otherwise. It will be further understood that the terms "comprises" and/or "comprising" and "includes" and/or "including" when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

It will be understood that when an element or layer is referred to as being "on" or "connected to", "coupled to", or "adjacent to" another element or layer, it can be directly on or connected, coupled, or adjacent to the other element or layer, or intervening elements or layers may be present. In contrast, when an element is referred to as being "in contact" or "directly connected to", "directly coupled to", or "immediately adjacent to" another element or layer, there are no intervening elements or layers present.

Unless otherwise defined, all terms (including technical and scientific terms) used herein have the same meaning as commonly understood by one of ordinary skill in the art to which this disclosure belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Peristaltic pumps are generally used to pump sterile or aggressive liquids, avoiding cross contamination by not having the liquid pass through a separate chamber. Depending on the design, peristaltic pumps may allow fluid to only contact the holding tank and the tube, reducing the need for valves and other forms of seals that can contaminate the liquid or present an opportunity for the liquid to damage the valves.

Figure 1B:
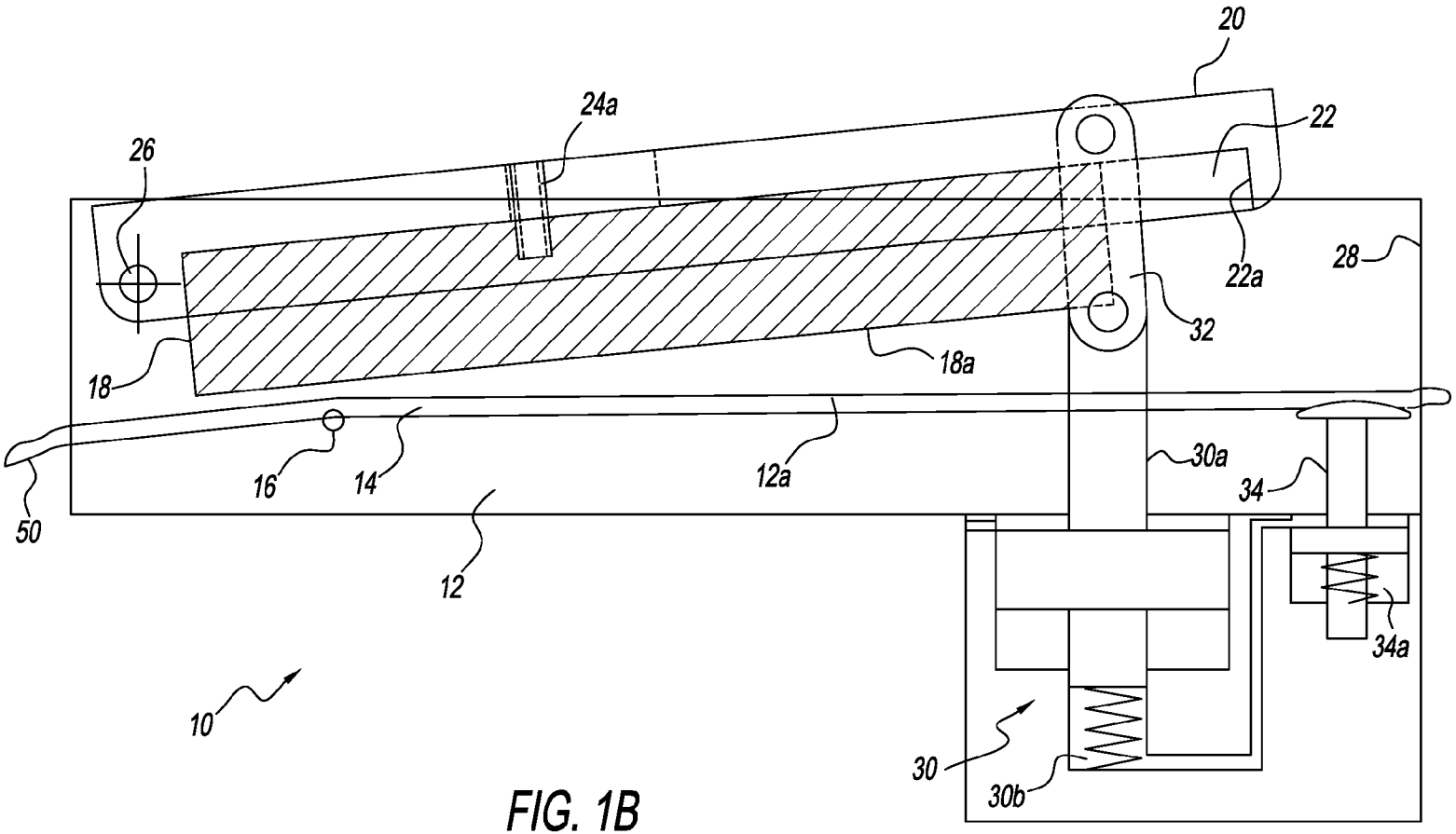

FIGS. 1A and 1B illustrate one example of a peristaltic pump 10. FIG. 1B is the same as FIG. 1A, but also includes a tube 50 through which liquid flows and is dispensed; the tube 50 is left out of FIG. 1A for clarity and will be discussed further below. Pump 10 includes a base plate 12 with a groove 14 formed in a top surface 12*a* of the base plate 12. The base plate 12 is rigid and may be metal. In some embodiments, the base plate 12 is semi-rigid, or is made of both rigid and semi-rigid materials. For example, the base plate can be made from machined, cast, or molded material such as metal. It may be formed from plastic, such as that manufactured from an injection-molding machine. The base plate 12 may be formed from a combination of both plastics and metals. The type of material used to form the base plate is not limited to the examples described herein.

The groove 14 has a width and depth approximately to accommodate the size of a tube 50 (see FIG. 1B) used to transmit liquid from a source tank (not shown) to a downstream location (not shown). The groove may be larger than the tube 50, and may prevent the tube from substantial movement during pump operation. The groove may be wider than the diameter of the unflattened tube so that when the tube is compressed, the tube may have room to flatten itself out in the width direction of the groove (e.g., in viewing a cross section of the tube, when flattened, the tube may extend between and fit within the sidewalls of the groove). Alternatively, the tube 50 may fit neatly into the groove such that lateral movement (in and out of the plane of the paper of FIG. 1A) is substantially prevented. The groove 14 may also assist in limiting vertical movement of tube 50 due to frictional forces between the sidewalls of the groove 14 and tube 50. The groove 14 may have a consistent depth and vertical cross section shape. Alternatively, the groove 14 may gradually deepen from the upstream side (left side of FIG. 1A, path of liquid flow connecting the source tank to the pump) to the downstream side (right side of FIG. 1A, path of liquid flow connecting the pump to the downstream location). The groove 14 may also be a bottom trench in the base plate 12, with many of the same characteristics as the groove 14.

The base plate 12 includes a bump 16 that extends above the groove 14. The bump 16 may be a pinch point of tube 50. The bump 16 is not limited to a specific shape and may be, for example, circular, square-shaped, conical, and so forth. In the example of FIG. 1A, the bump 16 extends a vertical distance from the bottom of the groove 14 by approximately 50% the depth of the groove 14. Alternatively, the bump height may be chosen to be less than 50%, such as 25% to 50%, or 10% to 30% of the depth of the groove 14. The first bump may be above the lower surface of the first groove by a vertical distance of 10% to 80% of the uncompressed diameter of the tube. In other embodiments, no bump may be used in an alternative example. In such other embodiments, a bend in the groove 14 (corresponding to the location of the bump 16 shown in FIG. 1A) may be used as an initial pinch point of tube 50. The bend in the groove may be, for example, circular-shaped, square-shaped, and so forth. In some embodiments, the bump may comprise a rod composed of metal, plastic or elastomer inserted in a hole in the side of base plate 12 but is not limited to the examples described herein.

The base plate 12 includes a top surface 12*a* that may comprise two planar major surfaces that meet at an angle coinciding with the location of bump 16. According to an alternative embodiment, the top surface 12*a* may comprise a single planar surface with the groove 14 formed therein. The base plate 12 may include, for example, a top surface 12*a* that is flat with a slope of zero, flat with a positive slope, curved, or concave.

As shown in FIG. 1A, a squash plate 18 is adjustably fixed in rigid arm 20. Rigid arm 20 includes a slot 22 extending along its vertical length within which the squash plate 18 is fitted. Rigid arm 20 may be completely rigid and formed of materials such as metals, or it may be semi-rigid. The rigid arm 20 may, for example, be formed of both metals and plastics or all plastics. In some embodiments, the rigid arm 20 may be formed of materials similar to those used to form base plate 12.

The rigid arm 20 may also contain indicia that indicate an gradation of amount of volume of liquid that would dispensed from a tube on the side or top of the rigid arm 20. The rigid arm may include several sets of indicia, each with gradations of volume, where each indicia set is associated with a tube radius. For example, the rigid arm 20 may include a set of indicia that comprises a plurality of notches, each with an associated volume amount that indicates that, if the squash plate 18 were attached so that its downstream end were at a specific notch, and the tube 50 had the specified diameter of that indicia set, then the specified amount of volume would be dispensed from the tube 50.

The squash plate 18 may snuggly fit within the slot 22 to prevent twisting of the squash plate 18 along its vertical axis or may be attached to slot 22 by mechanical attachments that prevent twisting of the squash plate 18. The squash plate 18 may slide along the direction of the length of slot 22 within the rigid arm 20. The slot 22 in the rigid arm 20 may extend from an end location 22*a* near the end of rigid arm 20 near the downstream side of the pump (right side of FIG. 1A) through a second end of the rigid arm 20 near the upstream side of the pump (left side of FIG. 1A) (i.e., the slot may be unbounded on the upstream side). The slot 22 may have a longer length than the squash plate 18.

Squash plate 18 is not able to move lengthwise in the slot past the end of slot 22*a* at the downstream side of the rigid arm 20, which prevents squash plate 18 from sliding along a length of the slot 22 such that the most upstream position of the squash plate 18 is downstream of the location of bump 16 during operation of the pump 10. For example, the end of slot 22*a* may prevent the squash plate 18 from sliding in the slot 22 to a location where no portion or part of the squash plate 18 is in the same plane as the bump 16. As will be described further below, the slot 22 may operate such that, when the rigid arm 20 and squash plate 18 are rotated downward, a portion of the squash plate 18 acts to squash the tube in the same plane as the bump 16. The squash plate 18 and the bump 16 may together prevent the flow of liquid back upstream when a tube 50 is being squashed.

The squash plate 18 in this example has a flat bottom surface 18*a*. However, differently shaped bottom surfaces may be used. For example, the bottom surface 18*a* may have a curved or convex shape. In an alternative where the bottom surface 18*a* is convex, all or part of the convex bottom surface 18*a* would be shown in FIGS. 1A and 1B as curved. In other examples, the squash plate 18 may have a flat bottom surface 18*a,* but the flat bottom surface 18*a* may have a positive or negative slope, or a slope of zero.

A thumbscrew fixes the squash plate 18 within slot 22 such that the squash plate is prevented from sliding along the direction of the length of the slot 22 when the thumbscrew is screwed to apply pressure to the squash plate 18. When the thumbscrew is retracted out of contact with squash plate 18, the squash plate 18 is moveable along the axis of slot 22. Note that in FIG. 1A, only the thumbscrew hole 24*a* is shown. Other types of screws may be used in lieu of the thumbscrew. A plurality of thumbscrew holes 24*a* may be disposed in the slot 22. For example, thumbscrew holes 24*a* may be disposed in the slot 22 to correspond with the one or more sets of indicia on the rigid arm 20 indicating a gradation of volume amounts for dispensing.

Other mechanisms to allow movement of squash plate 18 along the length of rigid arm 20 may also be contemplated. For example, squash plate 18 may include two elongated slots extending along the length of squash plate 18. Squash plate 18 may hang from two rivets extending from the side of rigid arm 20 through the slots in the squash plate 18 such that the rivet heads (larger than the width of the slots) prevent the squash plate from detaching from the side of the arm, but allow the squash plate to slide along the rigid arm. In this alternative, the thumbscrew may screw into the side of the squash plate to fix the squash plate against the rigid arm 20 to prevent movement.

In some embodiments, the squash plate 18 may only be moved within slot 22 when the pump 10 is not in operation. For example, the squash plate 18 may be moved within the slot before or after the rigid arm 20 and squash plate 18 are rotated downwards to squash a tube 50. In some embodiments, the squash plate 18 may be moved within the slot 22 in a routine manner (i.e. moved back and forth between 2 predetermined locations after 5 squashing operations, in order to repeat a cyclical pattern of dispensing a first amount of liquid for five operations of the pump 10 and then dispensing a second amount of liquid for five operations of the pump 10). The cyclical patterns of dispensing liquid from the tube 50 are not limited to the examples described herein.

In some embodiments, a controller and/or an automated system may be used to determine when and where to move the squash plate 18 within the slot 22. For example, a controller may be set by a user to determine how much liquid to dispense from a tube, where and when to move the squash plate, and so on. In other embodiments, the squash plate 18 may be moved within the slot 22 manually (e.g., loosening of thumbscrews used to fix squash plate 18 to a certain location within the slot 22) and a controller may be unnecessary. Measurement indicia (e.g., such as various milliliter amounts ("10 ml, 20 ml, . . . etc.") may be fixed to the squash plate 18 or rigid arm 20 (and a reference line or arrow on the other of the squash plate 18 or rigid arm 20) to indicate an amount of liquid to be dispensed by an operation cycle of the pump. A user may then adjust the location of the squash plate 18 within slot 22 using such measurement indicia.

The rigid arm 20 is attached to a housing 28 via a hinge 26 to allow rotation about the axis of the hinge 26. The hinge 26 may comprise a simple bar inserted in a hole in the side of rigid arm 20. Alternatively, hinge 26 may comprise a bearing assembly or other mechanism, such a hook. In some alternative embodiments, the squash plate 18 and the rigid arm 20 may be supported by end plates or hooks that allow the rotation of the squash plate 18 with the use of a bearing.

A linear actuator 30 may be hydraulic, pneumatic or electric. For example, it may comprise an electric solenoid that, when activated, pulls arm 30*a* of the linear actuator 30 downward. In an alternative embodiment, the actuator 30 may be replaced by a rotating cam operated by an electric motor or other source of rotary motion. The cam may be positioned above rigid arm 20 to push downwardly on rigid arm 20 (or the cam may be rotatably connected to the side of rigid arm 20) such that for each rotation of the cam, the rigid arm completes a cycle of compressing tube 50 between the lower surface 18*a* of the squash plate 18 and base plate 12 and subsequent releasing of such compression, as described previously. In some embodiments, a spring 30*b* biases the actuator to an upward position. An arm 30*a* of the linear actuator 30 may be mechanically connected to rigid arm 20 via a link 32 or other mechanical connector. When the arm 30*a* is pulled downward, the rigid arm 20 (and adjustably attached squash plate 18) rotate about hinge 26 (e.g. in a clockwise direction with respect to FIG. 1A). In some embodiments, the linear actuator 30 may be an integral part of the rigid arm 20 and squash plate 18. For example, the squash plate 18 may fit into an air actuated cavity.

The rigid arm 20 and adjustably attached squash plate 18 may rotate downward in the axis of the hinge 26 to progressively squash a tube 50 disposed in the groove 14. Before rotating downwards, the squash plate 18 may not have any contact with the tube 50. Alternatively, the squash plate 18 may contact the tube 50 but may not exert any pressure on the tube 50. By the end of a rotation motion, when the squash plate 18 and rigid arm 20 have rotated to their most downward position, the entire length of the portion of a tube 50 in contact with the squash plate 18 may be squashed. By moving the squash plate 18 within the slot 22, the amount of contact that the squash plate 18 has with a tube 50, and, correspondingly, the amount of liquid dispensed by the tube 50 when squashed, may be controllably varied. In alternative embodiments, a compression plate or flattening bar may be used. The types of plates or bars used to squash the tube 50 are not limited to the examples described herein. In some embodiments, other methods of flattening, compressing, or squashing the tube 50 may be used.

In some embodiments, the tube 50 may also be moved within the pump 10 backwards or forwards by, for example, several inches, to extend the life of the tube 50 and change the portion of the tube 50 that comes in contact with the squash plate 18. The tube may not be tacked, clamped or in any other manner permanently or irrevocably attached to the pump 10. Rather, as mentioned above, the tube 50 is placed in the groove 14. The tube 50 may be moved, removed, or replaced in the exemplary pump 10 with relative ease but may still maintain its position without significant movement when disposed in the groove 14.

A downstream valve 34 operates to prevent liquid in tube 50 from flowing upstream. FIG. 1A illustrates a pinch valve 34 that is biased to pinch tube 50 (not shown in FIG. 1A) closed with spring 34*a*. When the pressure of the liquid in the tube 50 (due to squashing of the tube by squash plate 18) becomes sufficiently high, the pinching of tube 50 by downstream valve 34 is overcome and the liquid in tube 50 is allowed to flow downstream. Alternatively, the valve may be mechanically actuated by air (pneumatic), liquid (hydraulic) or a solenoid (electric). Alternatively, the valve may apply a constant force only from, for example, a spring (such as 34*a*). Valve 34 may be a check valve, a constant force valve or a common or selectable pinch valve system. Alternatively, the valve 34 may be a common plate that pushes downward on the tube 50. The mechanism used in valve 34 is not limited to the examples described herein.

Housing 28 may be any structure to hold the above referenced elements in their relative positions. The housing may fix hinge 26 and fix bottom plate 12, and linear actuator 30, rigid arm 20, and valve 34 may be moveably disposed within the housing at fixed locations. Alternatively, while examples describe adjusting the relative positioning of a squash plate 18 and base plate 12 by moving the squash plate 18 within housing 28, the squash plate 18 may remain fixed within the housing 28 and the position of the base plate 12 may be adjusted to alter the relative positioning of squash plate 18 and base plate 12.

Tubing 50 is a compliant, resilient piece of tubing running from a fluid supply (not shown), through the pump 10 and downstream to a dispense point (not shown). Tubing may be chosen based on the need of the pump. While the pump 10 is not limited to using any particular type or size of tube, a tube with a small inner diameter may be preferred in certain implementations. For example, the ratio of thickness of the tube wall to the inner diameter of the tube may be less than 1, less than 0.5 or less than 0.3. One example of implementation of the pump 10 may be using the pump for precise dose dispensing.

Figure 4:
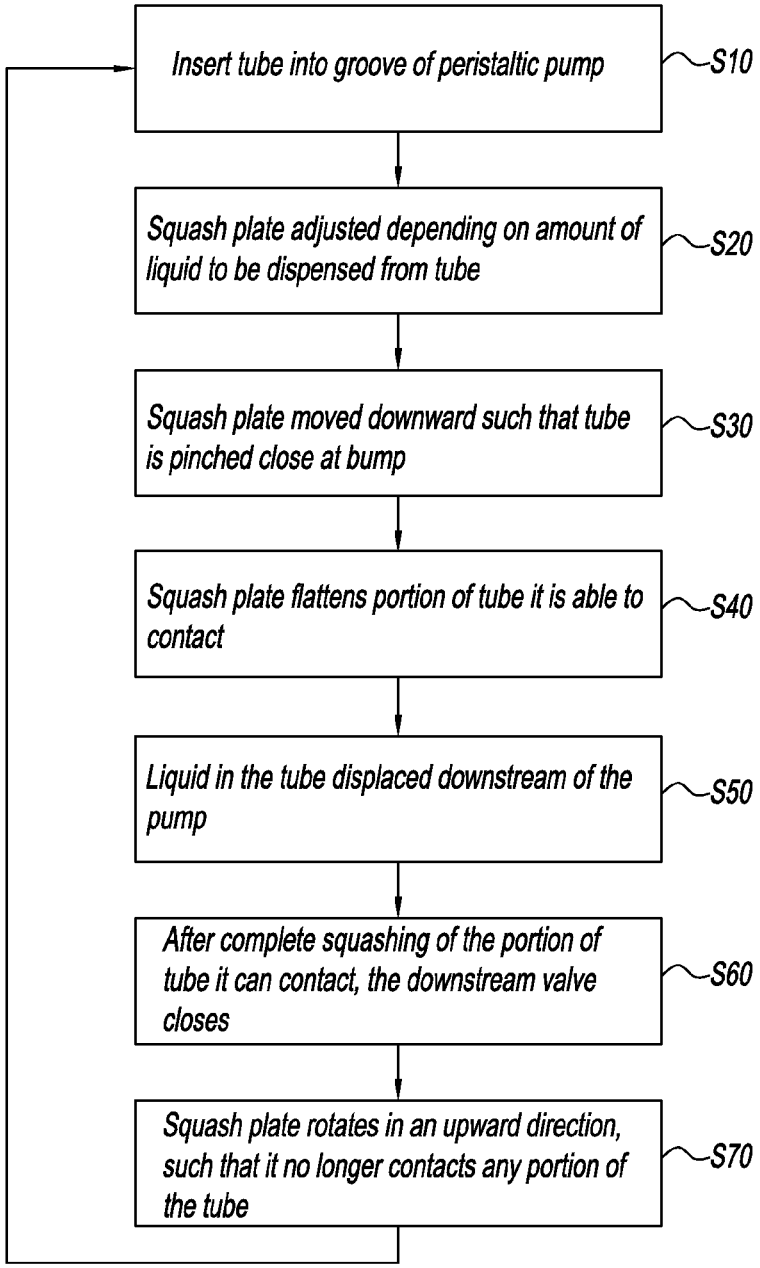
FIG. 4 is a flowchart of an exemplary pumping operation.

FIG. 4 depicts an exemplary operation of the pump 10. In step s10, tube 50 is placed in groove 14. The upstream end of tube 50 is placed within a source supply and the downstream end of tube 50 is attached or placed based upon use of pump (e.g., connected to a dispenser). The tube may be primed to be filled with the liquid from the supply. In some embodiments, the pump 10 may be capable of self-priming. In certain designs, it may be possible to use the pump 10 to pump air out of the tube 50 and fill the tube 50 with liquid based up on a resulting vacuum.

In step S20, in some embodiments, the squash plate 18 may be adjusted by sliding the squash plate within slot 22 along the length of slot 22 (having an axis parallel to the axis of the rigid arm 20 in the example of FIG. 1A). The thumbscrew 24 or other fixers may be used to fix the squash plate 18 against rigid arm 20 to prevent the squash plate 18 from moving with respect to the rigid arm 20. For example, the squash plate 18 may be adjusted with regard to the indicia on the rigid arm 20, based on a desired amount of tube output.

The location of the squash plate within slot 22 will determine a dispensing dose amount resulting from each pump cycle. In the example of FIG. 1A, the dose amount corresponds to the volume of liquid in the tube from bump 16 to the end of squash plate 18 (on the right side of FIG. 1A). For example, the dose amount may be $L \times pi \times r^2$ where L is the length of the tube from the bump 16 to the end of the squash plate (when the squash plate is rotated downward and compressed against tube 50) and r is the inner diameter of the tube 50. In some embodiments, the adjustable dose volume may vary. In some embodiments, steps S10 and S20 may be interchangeable, with step S10 occurring before or after step S20.

At the beginning of an exemplary pump cycle, tube 50 is filled with the liquid to be pumped, valve 34 maintains the tube 50 as closed and the rigid arm 20 is raised so that the squash plate 18 is not in contact with tube 50 (or, alternatively, the squash plate 18 may be slightly contacting tube 50) (e.g., as shown in FIG. 1A). In some embodiments, the pinch point force is adjustable.

Upon actuation of actuator 30, the rigid arm 20 is rotated downward around hinge 26. The squash plate 18 fixed to rigid arm 20 first comes in contact with tube 50 at a location near bump 16. In step S30, the continued rotational movement results in pinching the tube 50 closed at bump 16 before any further downstream closure of the tube 50 by squash plate 18. This closure at bump 16 provides a base point from which a precise dosage may be delivered from pump 10. Tube 50 is prevented from sliding along the base plate 12 of the pump since the squash plate 18 moves in a mostly vertical motion and the first press on the tube may help to clamp the tube 50 against subsequent motion during the dispense cycle. By minimizing the motion of the tube 50 during the pump cycle, the life of the tube may be extended, as the wear and tear on the tube 50 is reduced. In step S40, as the rigid arm 20 continues to rotate downward, the squash plate flattens the tube 50 within groove 14.

The valve 34 opens after the closure of the tube 50 at bump 16. The valve 34 may be opened by an increase in pressure of the liquid in the tube or may be independently actuated based upon programming or in response to a sensor (not shown) recognizing a position of the pump (e.g., pressure on the bump 16, location of rigid arm 20, etc.).

In step S50, with the valve 34 open, the liquid in tube 50 under squash plate 18 is displaced downstream, and a predetermined dosage amount is delivered at the downstream end of tube 50. In step S60, after complete squashing of the portion of the tube 50 with which the squash plate 18 comes in contact, the valve 34 closes (because the pressure from the liquid that had been in that portion of the tube 50 has gone). After the relevant portion of the tube 50 has been completely squashed, in step S70, rigid arm 20 lifts, allowing tube 50 to decompress back to its original shape. The decompression of the tube 50 may act like a vacuum, drawing liquid from the source (not shown). Because valve 34 is closed at this time, liquid is prevented from being drawn from a downstream side of the tube 50 (to the right of valve 34 in FIG. 1A). The pump is ready to start the next cycle. Before the next cycle begins, the squash plate 18 may be moved within the slot 22 to dispense a different amount of liquid from the tube 50.

Figure 2D:
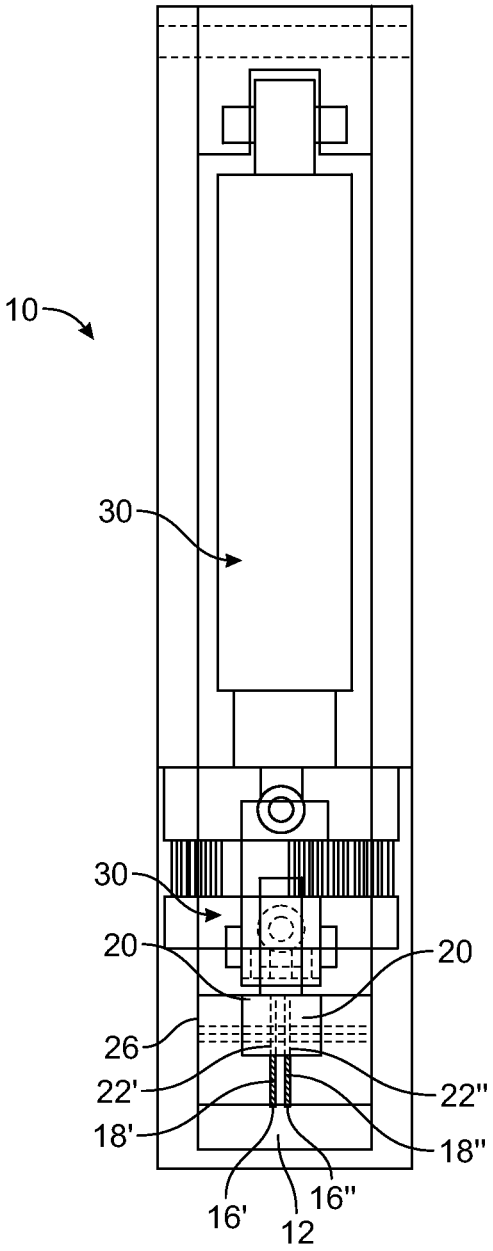
Figure 3A:
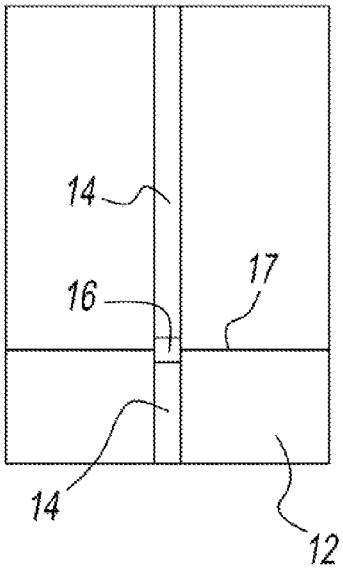
FIGS. 3A and 3B are top-down views of a base plate according to an exemplary embodiment and FIG. 3C illustrates a side view of a base plate of an exemplary embodiment.
Figure 3B:
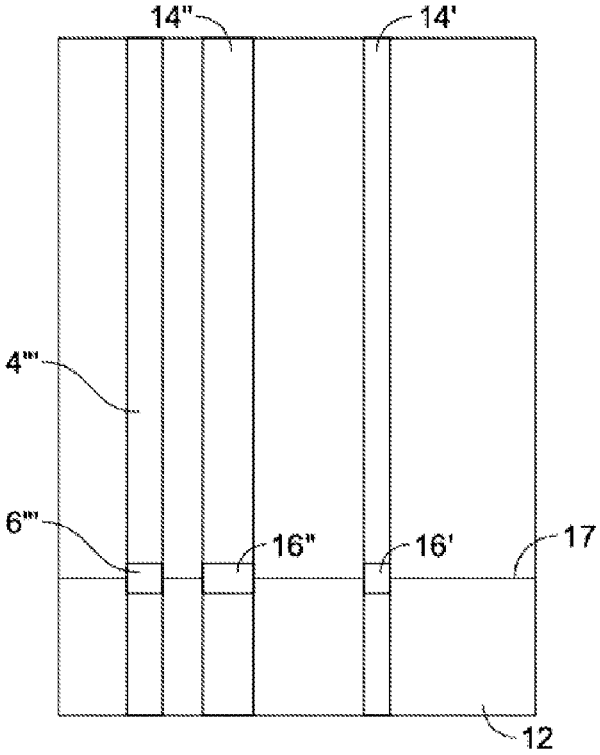

In a further alternative embodiment, as shown in FIG. 3B, base plate 12 may include a plurality of grooves 14 (shown in FIG. 3B as 14', 14" and 14'") each with a corresponding tube 50 placed therein. Valve 34 may have a single pinch bar to pinch all tubes in a coordinated fashion. Alternatively, each tube 50 may be pinched with a corresponding valve 34 to close off each tube individually. Each tube may have its own source liquid provided by a corresponding tank (not shown), or each tube may have source liquid from the same source tank (not shown). Multiple adjustable squash plates 18 may be attached to a single rigid arm 20. The actuation and pumping for each tube 50 in each groove 14 would remain as described above or would be variations thereof within the spirit of this disclosure. In this alternative, a wide variety of source liquids may be combined in multiple sized dosages. For example, the multiple squash plates 18 (such as squash plates 18' and 18" of FIG. 2D), each corresponding to a different groove 14, may be able to move independently. The dosage corresponding to each tube may be adjusted by the corresponding adjustment of the squash plate 18 unique to that tube 50. As mentioned above, a controller may be set by a user to control when and where each of the squash plates 18 are placed in the rigid arm 20, a pump cycle operation, and so forth. Alternatively, a single squash plate 18 may act to squash all tubes 50 in all of the grooves 14 at the same time, when the dosage of each tube 50 is desired to be the same.

In some embodiments, by providing different sized grooves, different sizes of tubes 50 may be accommodated. This allows for a larger range of dosages to be provided by a single pump, whether for a single liquid dosage application or for use in multiple liquid dosage application. In this embodiment, multiple squash plates 18 or a single squash plate 18 may be used.

In some embodiments, multiple grooves 14 may provide a pump 10 having fewer constraints in its use, giving the user more flexibility in its implementation. The manufacture of the pump 10 could thus be made more generic for multiple different uses. For example, if the base plate 12 included multiple grooves (e.g. 5 or 10 grooves 14), only some (e.g. three) of the grooves 14 might be used to hold a tube 50 for the pumping operation and the remaining grooves 14 would be empty in one implementation, and, in another implementation, all the grooves 14 of the base plate 12 may be occupied with tubes 50 and used in a pumping operation.

In a further alternative to the multiple groove embodiment, the multiple squash plates 18 may be attached to multiple rigid arms 20. These rigid arms 20 may be actuated by a single actuator or multiple actuators similar to actuator 30. The rigid arms 20 may act independently of each other or in concert.

In some examples, the pump 10 may avoid any use of seals, valves and/or chambers to reduce opportunities that the fluid to be pumped comes into contact with external substances. The tube 50 may be replaced with new tubing. The tube 50 may also be moved forward or backward along groove. This may help extend tube life and reduce maintenance. When the motion to actuate the pump provides substantially only a vertical pressure (e.g., a pressure perpendicular to the length of the tube), tube creep can be reduced or eliminated.

Figure 2A:
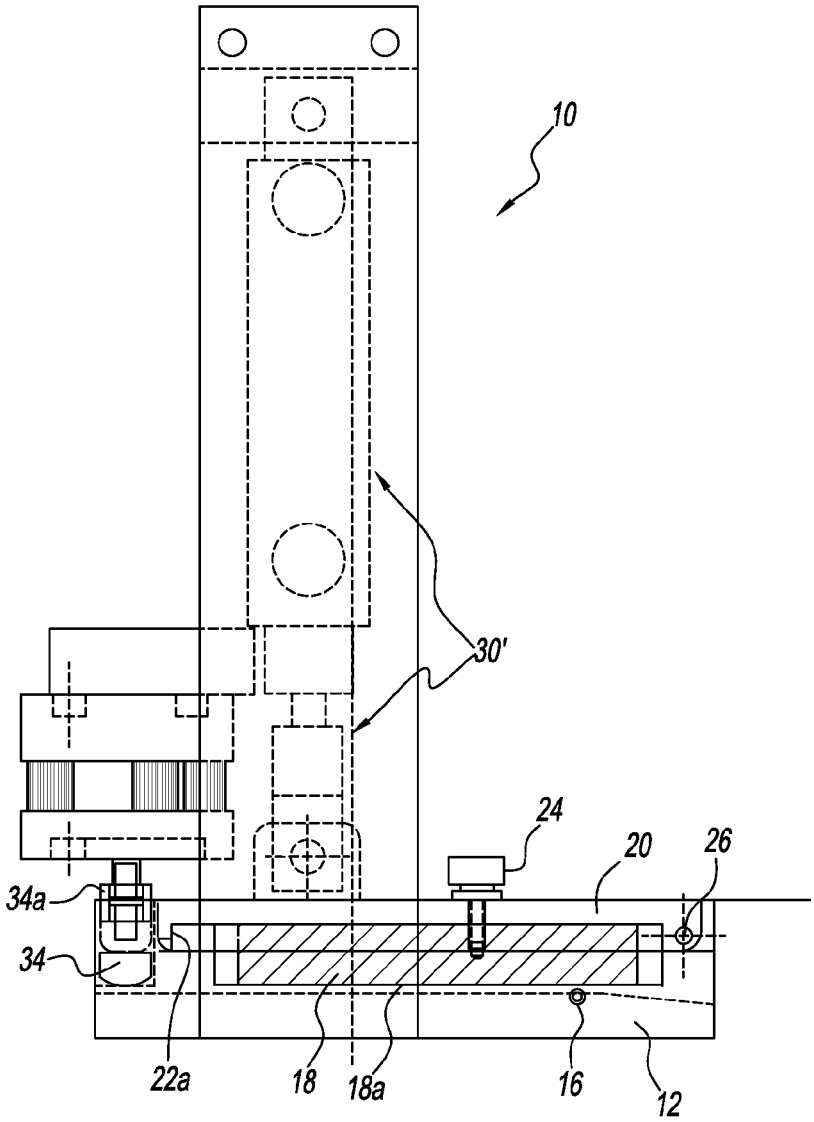
FIGS. 2A and 2B are alternative side views of a peristaltic pump according to an exemplary embodiment and FIG. 2D illustrates an alternative example to FIG. 2B.
Figure 2B:
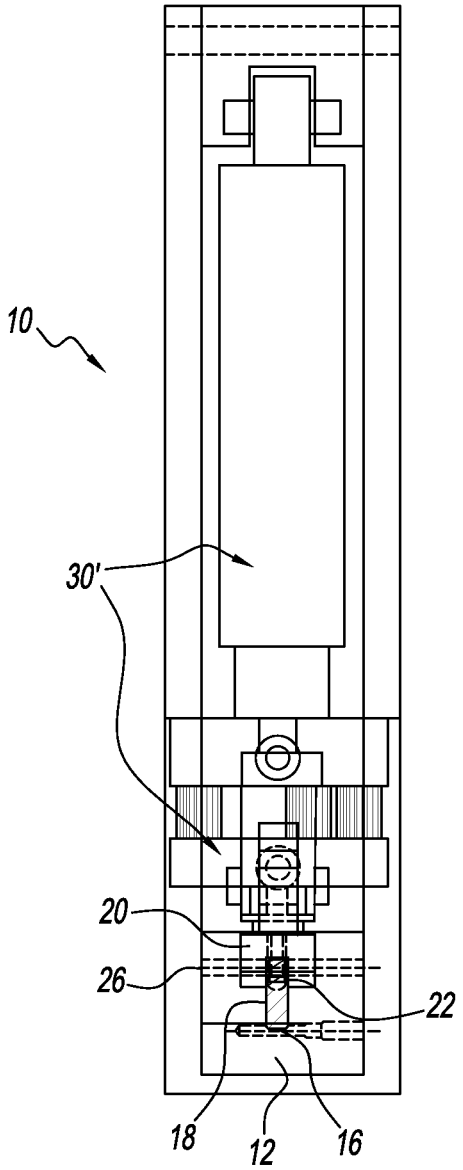
Figure 2C:
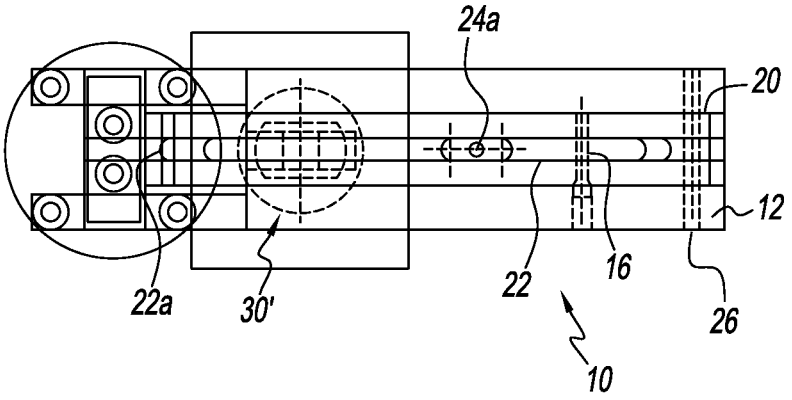
FIG. 2C is a top down view of the peristaltic pump of FIGS. 2A and 2B.

FIGS. 2A, 2B and 2C illustrate an alternative example of a pump 10. FIGS. 2A and 2B are alternative side views (taken at right angles to each other) and FIG. 2C is a top down view of the pump 10. The same numeric labels are used to represent the structure associated with the corresponding numeric labels used to describe the embodiment of FIGS. 1A and 1B. Detailed description of their structure and operation are therefore self-apparent and not necessary. As will be noted, in the embodiment of FIGS. 2A-2C, the actuator 30 of FIGS. 1A and 1B has been replaced with actuator 30'. Actuator 30' is located above rigid arm 20 and pushes down on rigid arm 20 to squash a portion of tube 50 with squash plate 18 during a pump cycle.

Figure 3C:
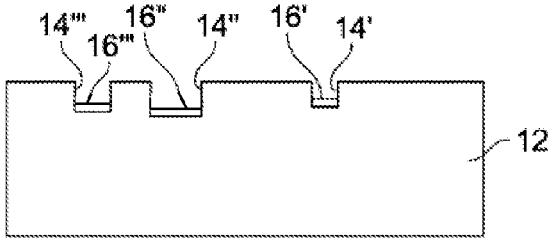

FIGS. 3A and 3B illustrate a top down view of examples of a base plate 12. FIG. 3A illustrates a base plate 12 with a single groove 14. Bump 16 is shown within the groove and lies along line bend 17 (where two major planar top surfaces of base plate 12 intersect. FIG. 3B illustrates another example of base plate 12 having three grooves 14', 14" and 14' ", each having a corresponding one of bumps 16', 16" and 16'" formed therein. The three grooves 14', 14" and 14'" are of different widths to accommodate different sized tubing. The depths of the three grooves 14', 14" and 14'" may also be different from each other (see, e.g., a side view of an example base plate 12 in FIG. 3C). Alternatively one or more of the plurality of grooves 14 of the base plate 12 of FIG. 3B could have the same size.

An exemplary pump as disclosed herein may be used for a variety of applications, ranging from intravenous fluid dispensing, use during cardiac surgery, ink-jet printing, and so forth. In one example, the exemplary peristaltic pump may be used in egg inoculation. The exemplary peristaltic pump is capable of accurate, repetitive dosing that may occur at relatively low pressures. The pumped fluid output pressure may be adjusted based on the force from the actuators. The force from one or more actuators may also be adjustable. Each of the peristaltic pumps may include the ability to dispense liquids from one or more tubes. The applications and configurations of an exemplary peristaltic pump are not limited to the examples described herein.

The above-disclosed subject matter is to be considered illustrative, and not restrictive, and the appended claims are intended to cover all such modifications, enhancements, and other embodiments, which fall within the true spirit and scope of the disclosed embodiments. Thus, the invention is to be determined by the broadest permissible interpretation of the following claims and their equivalents, and shall not be restricted or limited by the foregoing detailed description.

What is claimed is:

1. A peristaltic linear pump to dispense a varied volume of liquid from a tube, comprising:

a base plate with at least a first groove and a second groove formed in a top surface of the base plate, the first groove configured to hold a first tube in a lengthwise direction, the second groove configured to hold a second tube in a lengthwise direction;

a first bump formed at a first end of the base plate and in the first groove, and a second bump formed at the first end of the base plate and in the second groove;

a downstream valve configured to prevent liquid in the first tube from flowing upstream, a housing include a first movable arm disposed lengthwise in the housing;

a first squash plate adjustably fixed to the first movable arm and configured to move lengthwise with respect to the first movable arm, wherein the first squash plate is configured to squash a portion of the first tube, the portion of the squashed first tube extending from a downstream end of the first squash plate to the first bump; and a second squash plate adjustably fixed to the first movable arm of the housing and configured to move in a lengthwise direction in the housing, the second squash plate being configured to squash a portion of the second tube, the portion of the squashed second tube extending from a downstream end of the second squash plate to the second bump, wherein an amount of liquid dispensed from the first tube by the pump varies based upon a location of the first squash plate in the movable arm and an amount of liquid dispensed from the second tube by the pump varies based upon a location of the second squash plate in the moveable arm.

2. The linear pump of claim 1, further comprising:

a first linear actuator configured to move the first moveable arm in a vertical direction, such that the first squash plate is configured to first squash the first tube at the first bump and then configured to continue rotating the first squash plate downward to squash the squashed portion of the first tube and such that the second squash plate is configured to first squash the second tube at the second bump and then configured to continue rotating the second squash plate downward to squash the squashed portion of the second tube.

3. The linear pump of claim 1, wherein the first groove has a different size than the second groove.

4. The linear pump of claim 1, wherein a depth of the first groove is different from a depth of the second groove.

5. The linear pump of claim 1, wherein a depth of the first groove is larger at a downstream end than at an upstream end of the first groove.

6. A peristaltic linear pump to dispense a varied volume of liquid from a tube, comprising:

a base plate with at least a first groove and a second groove formed in a top surface of the base plate, the first groove configured to hold a first tube in a lengthwise direction and the second groove configured to hold a second tube in a lengthwise direction;

a first bump formed at a first end of the base plate and in the first groove and a second bump formed at the first end of the base plate and in the second groove;

a downstream valve configured to prevent liquid in the first tube from flowing upstream, a housing include a first movable arm disposed lengthwise in the housing;

a first plate and a second plate adjustably fixed in the first movable arm, wherein the first plate is configured to compress a portion of the first tube, the portion of the compressed first tube extending from a downstream end of the first plate to the first bump and the second plate is configured to compress a portion of the second tube, the portion of the compressed second tube extending from a downstream end of the second plate to the second bump;

wherein an amount of liquid dispensed from the first tube by the pump varies based upon a location of the first plate in the first movable arm and the amount of liquid dispensed from the second tube by the pump varies based upon a location of the first plate in the first movable arm.

7. The linear pump of claim 6, wherein bottom surfaces of the first plate and the second plate are flat.

8. The linear pump of claim 6, further comprising an actuator coupled to the movable arm, the actuator configured to move the movable arm along a vertical axis.

9. A peristaltic linear pump to dispense a varied volume of liquid from a tube, comprising:

a housing including a first flattening bar and a second flattening bar adjustably fixed to a movable arm;

a bottom plate with at least a first trench formed therein, the first trench configured to hold a first tube in a lengthwise direction, the first flattening bar and bottom plate being positioned within the housing to be movable relative to each other;

a first protrusion extending upwardly from an upstream end of the first trench;

a first pincher disposed at a downstream end of the first trench, the first pincher configured to prevent liquid in the first tube from flowing upstream;

a second trench formed in the bottom plate the second trench configured to hold a second tube in a lengthwise direction;

a second protrusion extending upwards from an upstream end of the second trench; and a second pincher configured to prevent liquid in the second tube from flowing upstream wherein the first flattening bar is configured to close a portion of the first tube from the first protrusion to a downstream end of the first flattening bar such that the first pincher is opened and the liquid in the closed portion of the first tube is dispensed, and wherein an amount of liquid dispensed from the first tube by the pump varies based upon a relative positioning of the first flattening bar and bottom plate.

10. The pump of claim 9, wherein the second flattening bar is configured to close a portion of the second tube from the second protrusion to a downstream end of the second flattening bar such that the second pincher is opened and the liquid in the closed portion of the second tube is dispensed.

11. The pump of claim 9, wherein the second adjustably attached flattening bar disposed in the housing has a fixed positional relationship with the first flattening bar to move together with the first flattening bar, the second flattening bar configured to close a portion of the second tube from the second protrusion to a downstream end of the second flattening bar such that the second pincher is opened and the liquid in the closed portion of the second tube is dispensed.

12. A method of dispensing a varied volume of liquid from a tube using a linear peristaltic pump, comprising the steps of:

placing a first tube in a first groove on a surface of a first plate and a second tube in a second groove on the surface of the first plate, the first groove having a first bump at an upstream end of the first groove and a first pinching valve at the downstream end of the first groove, and the second groove having a second bump at an upstream end of the second groove and a second pinching valve at the downstream end of the second groove; rotating a first squash plate and a second squash plate such that the first squash plate closes the first tube at the first bump and the second squash plate closes the second tube at the second bump; dispensing a volume of liquid from the first and the second tube by rotating the first and the second squash plate further downward such that the first squash plate closes the first tube from the first bump in a direction towards the first pinching valve and the second squash plate closes the second tube from the second bump in a direction towards the second pinching valve;

wherein lengths of the first and the second tube that are closed by the first and the second squash plate are adjustable.

* * * * *